US008899857B2

(12) United States Patent
Kageyama et al.

(10) Patent No.: US 8,899,857 B2
(45) Date of Patent: Dec. 2, 2014

(54) PIVOTAL MANIPULATION TYPE WRITING INSTRUMENT

(75) Inventors: Hidehei Kageyama, Kawagoe (JP); Akira Miyoshi, Kawagoe (JP); Masahiro Kaneko, Kawagoe (JP)

(73) Assignee: Kotobuki & Co., Ltd., Kawagoe-Shi, Saitama (JP)

( * ) Notice: Subject to any disclaimer, the term of this patent is extended or adjusted under 35 U.S.C. 154(b) by 367 days.

(21) Appl. No.: 13/369,216

(22) Filed: Feb. 8, 2012

(65) Prior Publication Data

US 2012/0207529 A1 Aug. 16, 2012

(30) Foreign Application Priority Data

Feb. 10, 2011 (JP) ..... 2011-027507

(51) Int. Cl.

| | |
|---|---|
| ***B43K 27/00*** | (2006.01) |
| ***B43K 7/00*** | (2006.01) |
| ***B43K 29/00*** | (2006.01) |
| ***B43K 24/14*** | (2006.01) |

(52) U.S. Cl.

CPC ..... *B43K 29/00* (2013.01); *B43K 7/005* (2013.01); *B43K 24/14* (2013.01); *B43K 27/00* (2013.01)

USPC ..... 401/30; 401/29

(58) Field of Classification Search

USPC ..... 401/29–33

See application file for complete search history.

(56) References Cited

U.S. PATENT DOCUMENTS

| | | | | |
|---|---|---|---|---|
| 4,202,641 | A * | 5/1980 | Tomura | 401/32 |
| 4,268,183 | A * | 5/1981 | Sekiguchi | 401/30 |
| 4,549,827 | A * | 10/1985 | Mack | 401/29 |

FOREIGN PATENT DOCUMENTS

| | | |
|---|---|---|
| DE | 92 17 245 | 3/1993 |
| JP | 2007-276365 A | 10/2007 |
| JP | 2009-018498 A | 1/2009 |

OTHER PUBLICATIONS

European Search Report dated May 7, 2012.

* cited by examiner

*Primary Examiner* — David Walczak

(74) *Attorney, Agent, or Firm* — McGuinn IP Law Group, PLLC

(57) ABSTRACT

A pivotal manipulation type writing instrument includes a pivotable body pivotable relative to a container main body and a writing element ejecting unit configured to actuate and move a slider to urge a writing element to be ejected from the container main body as the pivotable body is pivoted. The pivotable body is pivotable relative to the container main body by 360° in either left or right direction, and the writing element can be returned to a retracted state in which the writing element is retracted into the container main body from an ejected state in which the writing element is ejected from the container main body by moving the pivotable body in either left or right direction.

12 Claims, 9 Drawing Sheets

PIVOTAL MANIPULATION TYPE WRITING INSTRUMENT

TECHNICAL FIELD

The present invention relates to a pivotal manipulation type writing instrument capable of ejecting or retracting writing elements by pivoting a pivotable body.

BACKGROUND ART

Such kinds of pivotal manipulation type writing instruments are disclosed in Japanese Patent Application Laid-Open Nos. 2007-276365 and 2009-018498. Each of the pivotal manipulation type writing instruments disclosed in these patent documents includes movable bodies having writing elements, a container main body for housing the movable bodies with the writing elements being capable of ejecting and retracting, biasing means for urging the writing elements to be always drawn into the container main body, a pivotable body having one end combined with the container main body and pivotably supported by the container main body, and writing element ejecting means for ejecting one of the writing elements from the container main body to a use state by means of the movable body in conjunction with the pivotal movement of the pivotable body.

The writing element ejecting means includes a cam surface formed on the rear end of the movable body and a pin provided in the pivotable body. The pin is moved to operate the cam surface by pivoting the pivotable body relative to the container main body by 180° in the left or right direction so that the movable bodies can be selectively moved to the writing element ejecting direction to eject the corresponding writing element from the container main body. On the contrary, the writing element can be retracted into the container main body by pivoting the pivotable body in the opposite direction.

However, in the pivotal manipulation type writing instrument of the related art, the pivotable body can be pivoted only by 180° in the left or right direction. In addition, since the pivotable body is moved only in a single direction to retract the ejected writing element, it is necessary for a user to consider the pivoting direction for manipulation, which is cumbersome.

SUMMARY OF INVENTION

The invention has been made to address such problems, and an object thereof is to provide a pivotal manipulation type writing instrument having improved operability.

In accordance with the present invention, there is provided a pivotal manipulation type writing instrument including a container main body, writing elements arranged in the container main body so as to be ejectable from or retractable into the container main body, sliders movably arranged in the container main body and mounted to the writing elements so as movable together with the writing elements, biasing elements configured to urge the writing elements to be retracted into the container main body, a pivotable body that is pivotable relative to the container main body, and a writing element ejecting unit configured to actuate and move any one of the sliders in a direction in which a corresponding writing element is ejected from the container main body as the pivotable body is pivoted. The pivotable body is adapted to be pivotable relative to the container main body by 360° in either left or right direction, and the writing element is allowed to return to a retracted state in which the writing element is retracted into the container main body from an ejected state in which the writing element is ejected from the container main body, by moving the pivotable body in either left or right direction.

The writing element ejecting unit may include an actuating portion pivoted together with the pivotable body to move on a circular track and an actuated portion provided on the slider, and the actuating portion moving along the circular track is adapted to abut on the actuated portion for actuation.

The slider may have a channel through which the actuating portion is allowed to pass.

One end of the channel may be configured so as not to allow the actuating portion to enter the channel, but only to allow the actuating portion to exit.

A bottom of the channel may be inclined from one end to the other end.

A part of the actuating portion may be inserted into a channel of an actuated portion provided in the other of the sliders when the actuating portion actuates the one of the sliders to eject the corresponding writing element from the container main body.

A pivoting track of the actuating portion may be included in the container main body.

A part of the actuated portion abutting on the actuating portion extends in a direction perpendicular to a moving direction of the slider.

The actuating portion may have a flat surface in a radially outer side of a circular track along which the actuating portion moves.

Two sliders mounted to respective writing elements may be arranged side by side within the container main body, and a stopper arranged between the two sliders to restrict the sliders from moving backward may be integrated with the container main body.

The pivotable body has an internal space capable of housing an arbitrary article.

The article includes a knife, a ruler, scissors, an earpick, or a storage medium such as a USE memory.

Since the pivotable body can be pivoted relative to the container main body by 360° in either left or right direction, it is possible to improve the operability without necessity of considering the pivotal direction for manipulation in order to retract the ejected writing element.

The present disclosure relates to subject manner contained in Japanese Patent Application No. 2011-027507, filed on Feb. 10, 2011, which is expressly incorporated herein by reference in its entirety.

DESCRIPTION OF EMBODIMENT

Hereinafter, an embodiment of the invention will be described with reference to the accompanying drawings.

FIGS. 1 to 4 are diagrams illustrating main parts of a pivotal manipulation type writing instrument according to an embodiment of the invention. Referring to FIGS. 1 to 4, the pivotal manipulation type writing instrument 10 has a container main body 12. The container main body 12 includes a main body casing 14 and a main body covering 16 which covers the main body casing 14 so as to provide a generally flat, elongated exterior shape along the lengthwise direction and define an internal space having a shallow depth thereinside.

Figure 5:
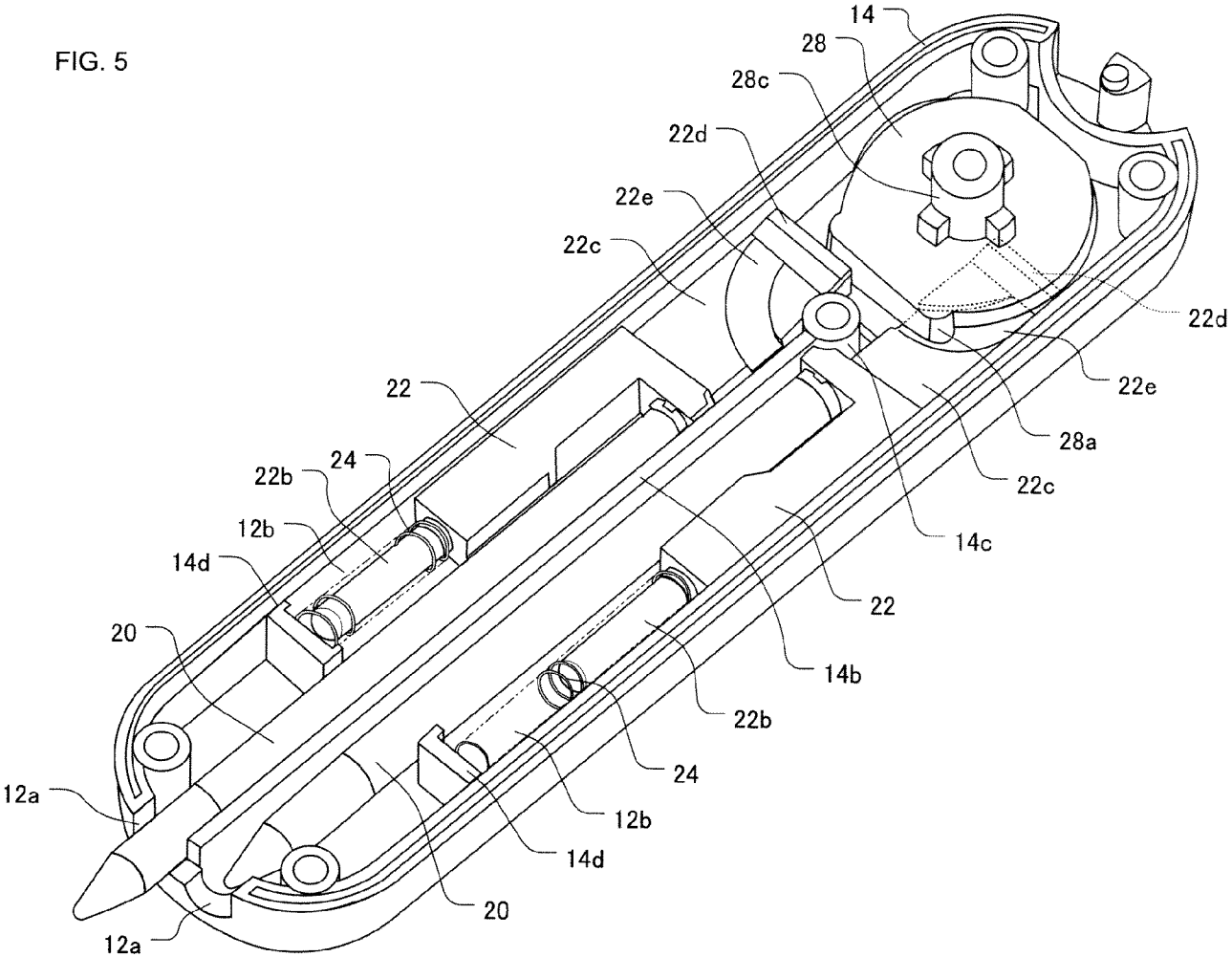
FIG. 5 is a perspective view illustrating an internal structure of the pivotal manipulation type writing instrument in the retracted state of the writing elements.

As illustrated in FIG. 5, the front end of the elongated main body casing 14 in the lengthwise direction has one or more concave portions 14*a* so as to define slots 12*a* along with the main body covering 16. In addition, the main body casing 14 internally has a partitioning wall 14*b* extending in the lengthwise direction from the vicinity of the front end to the vicinity of the rear portion. The internal space of the container main body 12 is divided by the partitioning wall 14*b* into two parallel compartments 12*b* excluding the rear portion. The rear end of the partitioning wall 14*b* is provided with a cylindrical portion 14*c*. A pin 16*a* is inserted from the main body covering 16 into the inner side of the cylindrical portion 14*c*, so that the cylindrical portion 14*c* and the pin 16*a* constitute a columnar stopper 12*c* (refer to FIG. 4). Furthermore, each of the compartments 12*b* is provided with a spring receiving wall 14*d* extending from the lateral side of the inner wall of the main body casing 14 toward the inside of the compartment 12*b* in a direction perpendicular to the partitioning wall 14*b*.

Two writing element 20 and sliders 22 mounted to the rear ends of the writing elements 20 are arranged in respective compartments 12*b*. The two writing element 20 may be a combination of two different types of writing element (for example, ballpoint pen refill having different color inks). The writing element 20 is movable in the lengthwise direction along each compartment 12*b* so as to eject or retract the pen nib thereof from or into the slot 12*a*.

Figure 6A:
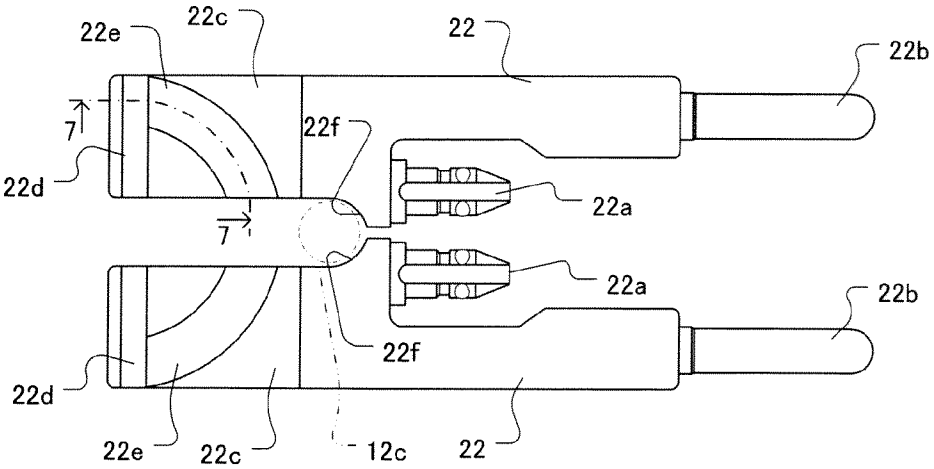
FIGS. 6A and 6B are a plan view and a side view, respectively, illustrating sliders of the pivotal manipulation type writing instrument.
Figure 6B:
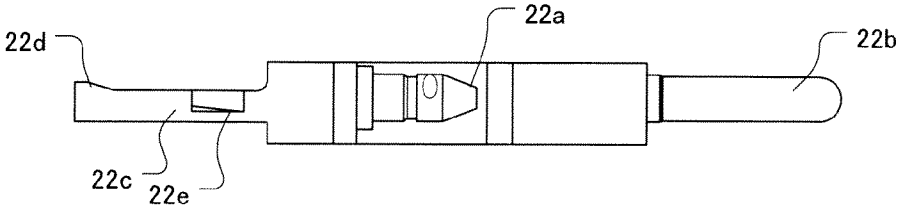

Each of the sliders 22 is made of resilient plastic or the like and is a molded component movable within the corresponding compartment 12*b*. As illustrated in FIGS. 6A and 6B, the slider 22 includes a writing element connecting portion 22*a* connected to the rear end of the writing element 20 on the front side thereof and a spring receving portion 22*b* provided in parallel with the writing element connecting portion 22*a*. A spring 24 is interposed as a biasing element between the spring receiving portion 22*b* and the spring receiving wall 14*d*. The writing element 20 and the slider 22 are always urged backwardly by the spring 24 so that the pen nib of the writing element 20 is urged to be retracted into the container main body from the slot 12*a*.

Figure 7:
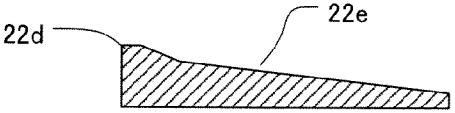
FIG. 7 is a cross-sectional view taken along the line 7-7 of FIG. 6A.

The rear end side of the slider 22 serves as a thin actuated portion 22*c*. The rear end portion of the actuated portion 22*c* is a thick portion 22*d* having a larger thickness than the other portion of the actuated portion 22*c*. The rear end surface of the thick portion 22*d* is a flat end surface perpendicular to the lengthwise direction. In the actuated portion 22*c*, a channel 22*e* having an arc shape with a center angle of 90° is formed from the inner side surface to the rear end surface. The bottom of the channel 22*e* is inclined to have a depth gradually increasing from the inner side surface to the rear end surface as illustrated in FIG. 7. The depth of the channel becomes zero in front of the thick portion 22*d*.

In addition, the rear portion of the inner side surface of the slider 22 serves as a stopper receiving portion 22*f* which is partially notched. The stopper receiving portion 22*f* is formed to receive the cylindrical stopper 12*c*.

Figure 8A:
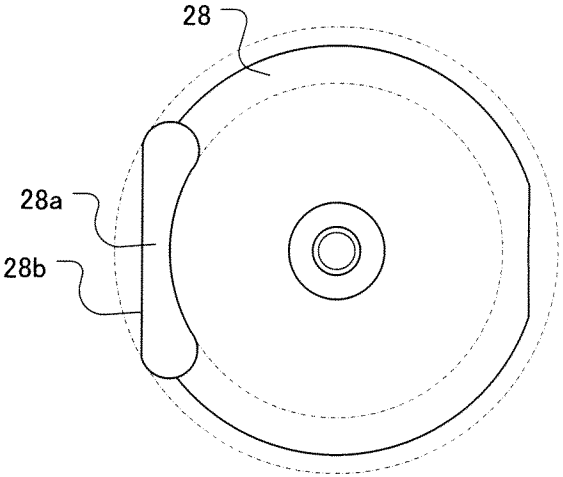
FIGS. 8A and 8B are a bottom view and a side view, respectively, illustrating a turning plate of the pivotal manipulation type writing instrument.
Figure 8B:
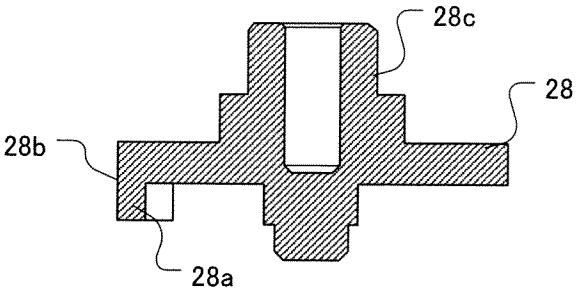

The rear portion of the inner space of the container main body 12 is provided with a circular turning plate 28. As illustrated in FIGS. 8A and 8B, an arc-shaped actuating projection 28*a* serving as an actuating portion is formed in a part of the periphery of the turning plate 28 such that a part of the periphery spreads beyond a circular contour of the turning plate 28. Incidentally, the outer peripheral portion located in the radially outer side of the actuating projection 28*a* has a flat surface 28*b*.

The actuating projection 28*a* serving as an actuating portion and the actuated portion 22*c* constitute a writing element ejecting unit.

A center shaft 28*c* is formed on the center of the turning plate 28. The center shaft 28*c* passes through the main body covering 16 of the container main body 12 and extends to the inner side of the pivotable body 30.

The pivotable body 30 includes a pivotable body casing 32 and a pivotable body covering 34. Similarly to the container main body 12, the pivotable body 30 has a generally flat, elongated exterior shape along the lengthwise direction and defines an internal space thereinside.

The pivotable body casing 32 includes a bearing portion 32*a*. The bearing portion 32*a* is engaged with the center shaft 28*c* of the turning plate 28, and they are fixedly connected with a screw 36 (refer to FIG. 4) so that the pivotable body 30 and the turning plate 28 can be pivoted or turned integrally, and the pivotable body 30 can be pivoted around the bearing portion 32*a* relative to the container main body 12.

Figure 9:
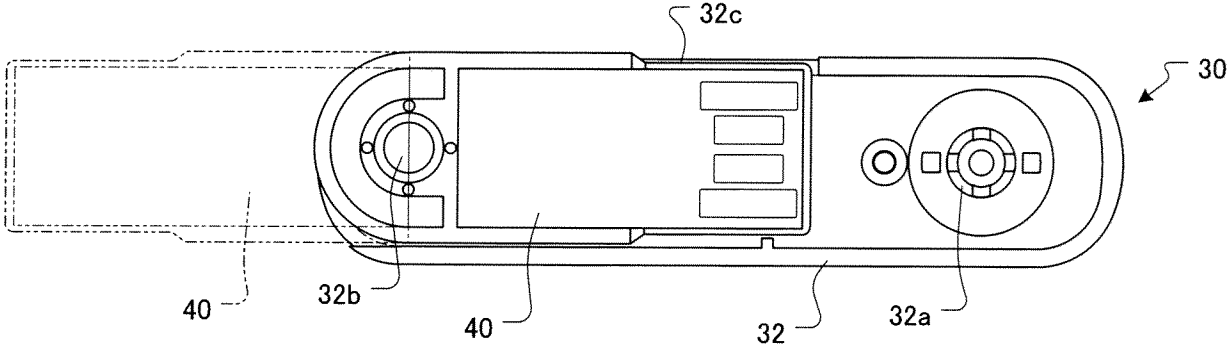
FIG. 9 is a transverse cross-sectional view (viewed from the line 9 of FIG. 4) illustrating a pivotable body of the pivotal manipulation type writing instument.

In addition, as illustrated in FIG. 9, the internal space of the pivotable body 30 is configured to house any arbitrary article 40 (such as a knife, a ruler, scissors, an earpick, a storage medium (such as a USB memory)). The article 40 is pivotably supported by the second bearing portion 32*b* of the pivotable body casing 32 so that it can be pivoted and deployed from the notch 32*c* formed in the lateral side of the pivotable body casing 32.

The operation of the pivotal manipulation type writing instrument configured as described above will be described.

Figure 1:
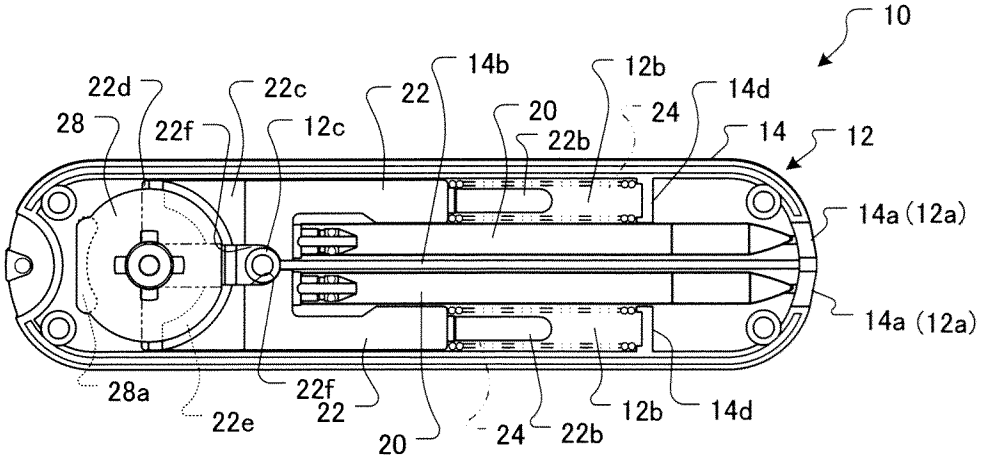
FIG. 1 is a transverse cross-sectional view illustrating a retracted state of writing elements of the pivotal manipulation type writing instrument according to an embodiment of the invention.
Figure 2:
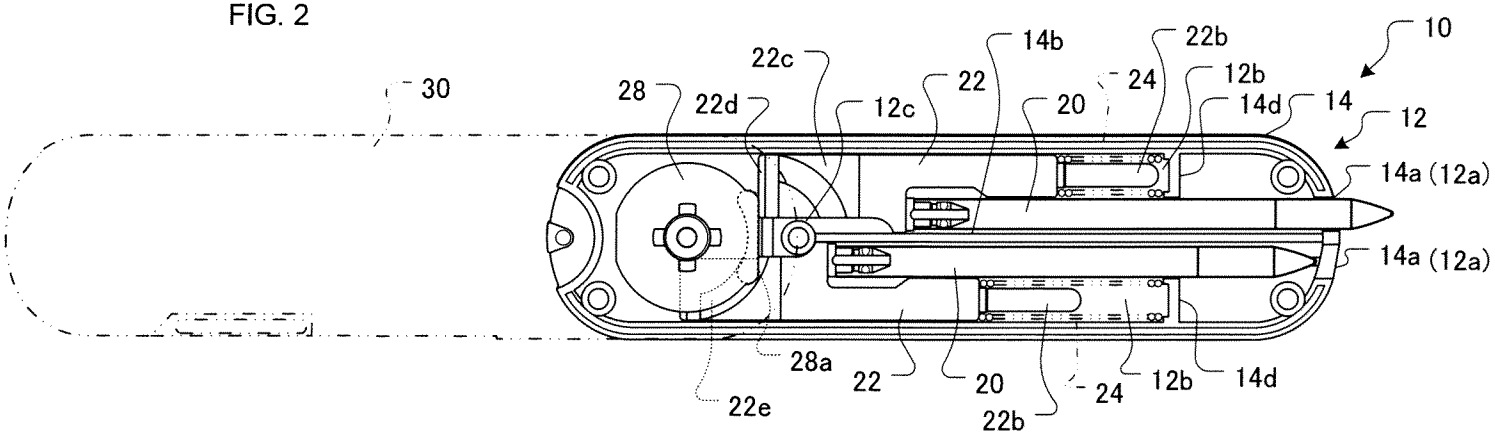
FIG. 2 is a transverse cross-sectional view (viewed from the line 2 of FIG. 4) illustrating an ejected state of one of the writing elements of the pivotal manipulation type writing instrument according to the embodiment of the invention.
Figure 3A:
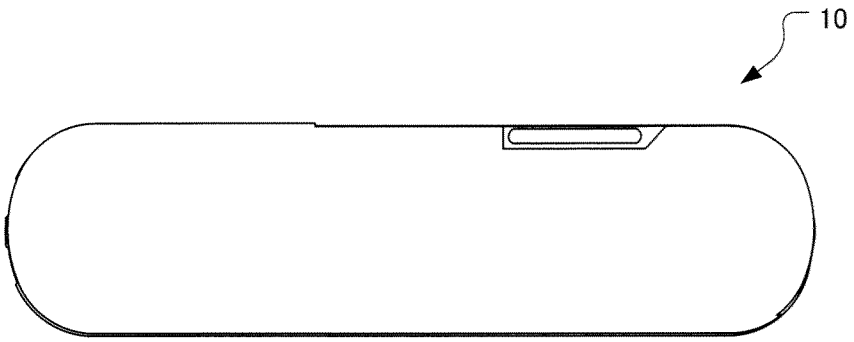
FIGS. 3A and 3B are plan views illustrating the retracted state and the ejected state, respectively, of the writing element of the pivotal manipulation type writing instrument.

As illustrated in FIG. 3A, in a state that the container main body 12 and the pivotable body 30 are completely overlapped with each other, all of the pen nibs of a plurality of writing elements 20 are retracted inside the container main body 12. In this retracted state, as illustrated in FIG. 1, the stopper receiving portions 22*f* of all of the sliders 22 abut on the stoppers 12*c*. As a result, the sliders 22 and the writing element 20 are restricted from moving backward further. In this case, the actuating projection 28*a* of the turning plate 28 is located in the rear end side farthest from the slot 12*a* on a circular track in the container main body 12 (FIG. 10A).

Figures 10A, 10B, 10C, 10D, 10E, 10F, 10G, 10H, 10I, 10J:
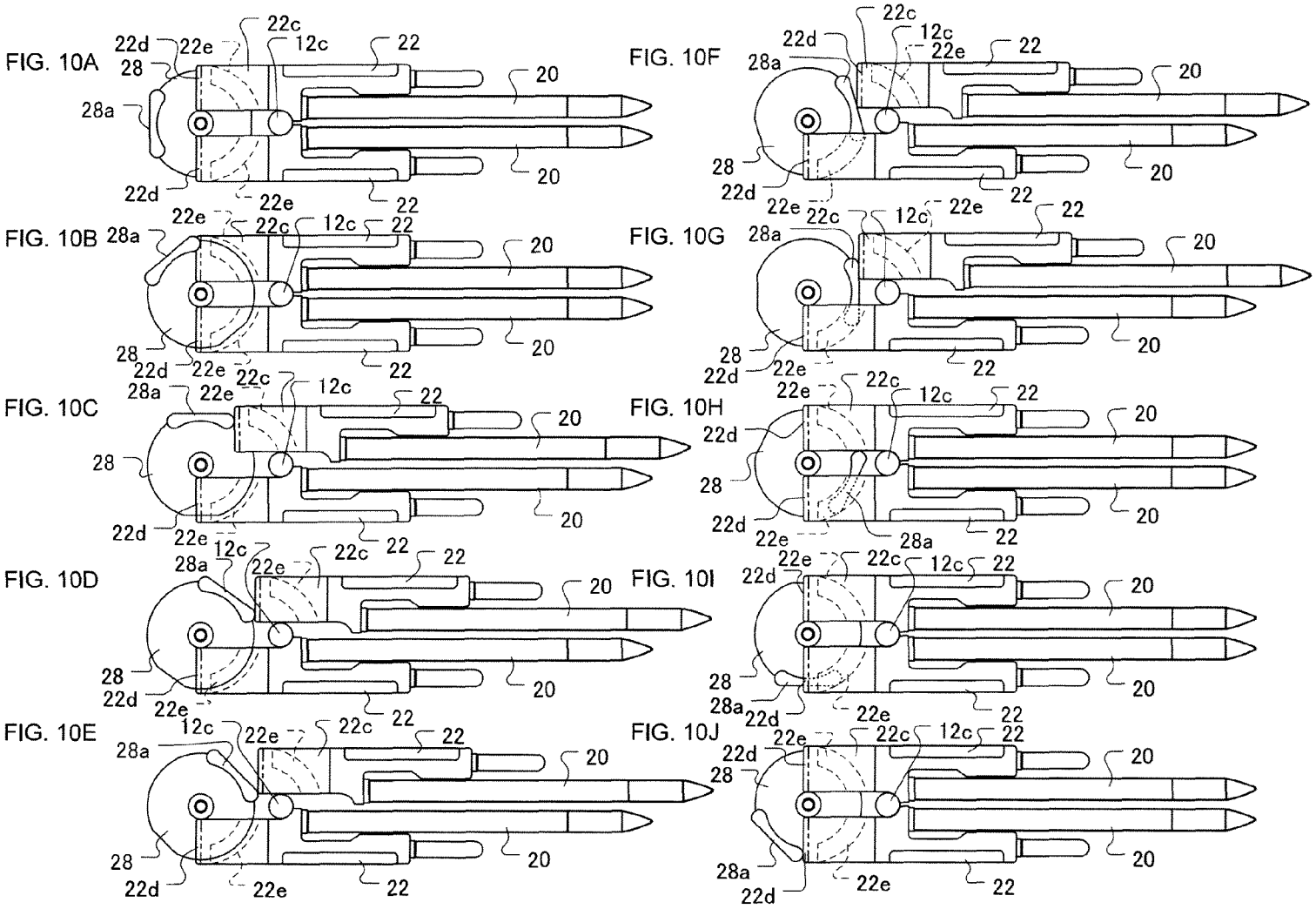
FIGS. 10A-10J are explanatory diagrams illustrating an operation of the pivotal manipulation type writing instrument.

When the pivotable body 30 is pivoted in either left or right direction from this state (FIG. 10B), the turning plate 28 is turned simultaneously, and the actuating projection 28*a* moves along the circular track so that a leading end of the actuating projection 28*a* abuts on the thick portion 22*d* of the actuated portion 22*c* of any one of the sliders 22 (FIG. 10C). Then, the actuating projection 28*a* presses the slider 22 toward the leading end side so that the slider 22 and the writing element 20 move against the urging force of the spring 24, and the pen nib of the writing element 20 can be ejected from the slot 12*a* of the container main body 12 (FIG. 10D). As the actuating projection 28*a* further moves along the circular track, the leading end of the actuating projection 28*a* is detached from the thick portion 22*d* (FIG. 10E), and the flat surface 28*b* of the actuating projection 28*a* slides along the thick portion 22*d*. Then, the leading end of the actuating projection 28*a* enters, from the inner side, the channel 22*e* of the actuated portion 22*c* of the other slider 22 (FIG. 10F). When the leading end of the actuating projection 28*a* is detached from the thick portion 22*d*, and the flat surface 28*b* makes contact with the thick portion 22*d*, a click can be sensed by a user.

Figure 3B:
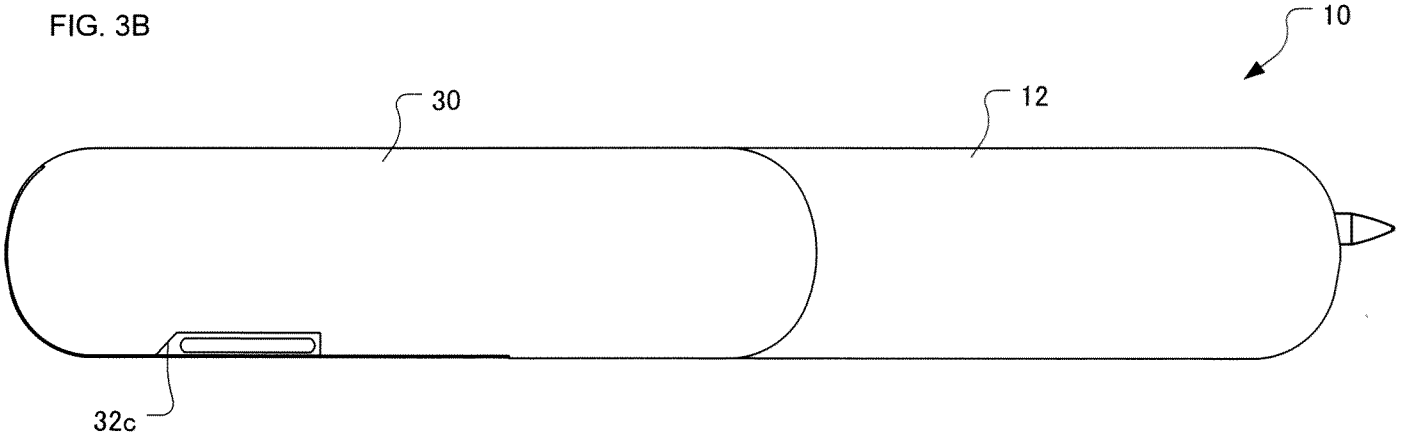
Figure 4:
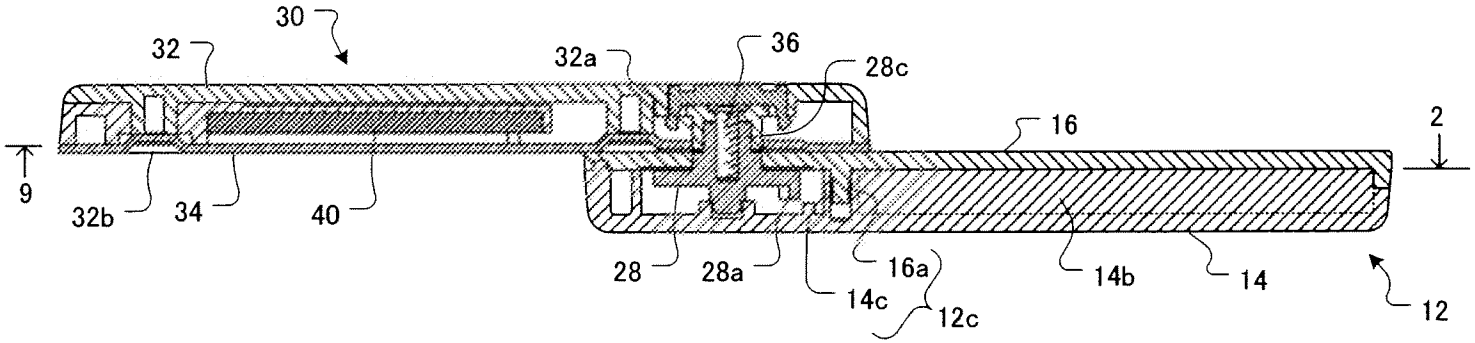
FIG. 4 is a longitudinal cross-sectional view illustrating the ejected state of the writing element of the pivotal manipulation type writing instrument.

As the pivotable body 30 is pivoted by 180°, and the actuating projection 28*a* of the turning plate 28 is located in the front end side closest to the slot 12*a* on the circular track in the container main body 12, the flat surface 28*b* of the actuating projection 28*a* makes surface contact with the flat end surface of the thick portion 22*d* of the actuated portion 22*c* of the slider 22 pressed toward the front side (FIG. 10G). As a result, the pen nib of the writing element 20 connected to the slider 22 that has moved forwardly is maintained in a state of being ejected from the slot 12*a* of the container main body 12. Therefore, in this ejected state, a user can write with the writing element 20 by gripping the pivotable body 30 and the container main body 12, and the writing element 20 is not retracted so as to allow stable writing even when a writing force is applied. In addition, in this ejected state, as illustrated in FIG. 3B, the pivotable body 30 is developed from the container main body 12 so as to facilitate gripping.

In addition, since the leading end of the actuating projection 28*a* of the turning plate 28 enters the channel 22*e* of the other slider 22, it is possible to prevent the other slider 22 from being moved unintentionally.

In order to retract the pen nib of the ejected writing element 20 after completing the writing, the pivotable body 30 is pivoted in any direction. The pivotal direction in this case may be identical to or opposite to the previous pivoting direction. When the pivotable body 30 is pivoted in the direction opposite to the previous pivoting direction, the actuating projection 28*a* is returned along the previous circular track, and the slider 22 and the writing element 20 are moved backward by the urging force of the spring 24. On the other hand, when the pivotable body 30 is pivoted in the direction identical to the previous pivoting direction, the actuating projection 28*a* passes through the channel 22*e* of the actuated portion 22*c* of the other slider 22. As a result, as the actuating projection 28*a* is completely detached from the actuated portion 22*c* of the one of the sliders 22, the slider 22 and the writing element 20 are retracted by the urging force of the spring 24 (FIG. 10H). At a moment the actuating projection 28*a* is completely detached from the actuated portion 22*c* of the one of the sliders 22, a click can be sensed by a user. In addition, if the pivotable body 30 is pivoted (FIG. 10I), the actuated portion 22*c* is slightly bent as the actuating projection 28*a* moves along the channel 22*e* because the bottom of the channel 22*e* is gradually raised. That is, since the actuated portion 22*c* is slightly bent as it recedes from the turning plate 28, the actuating projection 28*a* is allowed to move along the circular track. A click is sensed by a user at the last moment the actuating projection 28*a* passes through the thick portion 22*d* (FIG. 10J), and the pivotable body 30 may be returned to the original state.

The pen nib of the writing element 20 to be ejected can be selected based on the pivoting direction of the pivotable body 30 from the retracted state. In addition, in the ejected state, the pen nib of the ejected writing element 20 can be retracted by pivoting the pivotable body 30 in any direction.

Alternatively, if the pivotable body 30 is pivoted in the opposite direction before the actuating projection 28*a* completely exits from the channel 22*e* of the actuated portion 22*c* of the other slider 22 (FIG. 10J) after the pen nib of the one of the writing elements 20 is retracted by pivoting the pivotable body 30 in the same direction from the ejected state in which the pen nib of the writing element 20 is ejected (FIG. 10H), the pivotable body 30 can be developed while the pen nibs of all the writing elements 20 are kept to be retracted.

Since the depth of the channel 22*e* is largest in the inner side surface side, the actuating projection 28*a* can smoothly enter the channel 22*e* from the inner side surface side. Since the depth of the channel 22*e* is nearly zero in the thick portion 22*d* side, the actuating projection 28*a* is not allowed to enter the channel 22*e* from the rear side which is the thick portion 22*d* side, but is only allowed to exit from there. Therefore, when the actuating projection 28*a* approaches the thick portion 22*d* from the rear side, the actuating projection 28*a* reliably abuts on the thick portion 22*d* without entering the channel 22*e*, to thereby press the slider 22 forwardly.

In this way, the pivotable body 30 can be pivoted by 360° relative to the container main body 12 in either left or right direction. Therefore, since the pivotable body 30 can be pivoted in either left or right direction in order to retract the pen nib of the ejected writing element, it is possible to improve the operability without necessity of considering the pivoting direction to perform manipulation.

Since the circular track of the actuating projection 28*a* is included in the container main body 12, the actuating projection 28*a* does not need to enter or exit from the container main body 12, and it is not necessary to provide an opening for that purpose in the container main body 12.

Although the actuating projection 28*a* moves along the circular track, most of the distance taken by the circular track in the lengthwise direction can be utilized to move the slider 22. Therefore, it is possible to obtain a large stroke amount of the slider 22.

In addition, in the retracted state, the backward movement of the two sliders 22 is restricted by the stopper 12*c* provided therebetween, and the stopper 12*c* is shared by the two stoppers 12*c*. For this reason, it is not necessary to provide a stopper for each slider 22. Therefore, it is possible to effectively use the internal space of the container main body.

In the embodiment described above, an element made of a plurality of components may be configured as a single component, or an element made of a single component may be configured as a plurality of components.

While the principles of the invention have been described above in connection with the specific embodiment, and particular modifications thereof, it is to be clearly understood that this description is made only by way of example and not as a limitation on the scope of invention.

The invention claimed is:

1. A pivotal manipulation type writing instrument comprising:

a container main body;

writing elements arranged in the container main body so as to be ejectable from or retractable into the container main body;

sliders movably arranged in the container main body and mounted to the writing elements so as to be movable together with the writing elements;

biasing elements configured to urge the writing elements to be retracted into the container main body;

a pivotable body that is pivotable relative to the container main body; and a writing element ejecting unit configured to actuate and move any one of the sliders in a direction in which a corresponding writing element is ejected from the container main body as the pivotable body is pivoted, the pivotable body being adapted to be pivotable relative to the container main body by 360° in either left or right direction, and the writing element being allowed to return to a retracted state in which the writing element is retracted into the container main body from an ejected state in which the writing element is ejected from the container main body, by moving the pivotable body in either left or right direction.

2. The pivotal manipulation type writing instrument according to claim 1, wherein the writing element ejecting unit includes an actuating projection pivoted together with the pivotable body to move on a circular track, and an actuated portion provided in the slider, the actuating projection moving along the circular track being adapted to abut on the actuated portion for actuation.

3. The pivotal manipulation type writing instrument according to claim 2, wherein the slider has a channel through which the actuating projection is allowed to pass.

4. The pivotal manipulation type writing instrument according to claim 3, wherein one end of the channel is configured so as not to allow the actuating projection to enter the channel, but only to allow the actuating projection to exit.

5. The pivotal manipulation type writing instrument according to claim 3, wherein a bottom of the channel is inclined from one end to the other end.

6. The pivotal manipulation type writing instrument according to claim 3, wherein a part of the actuating projection is inserted into a channel of an actuated portion provided in the other of the sliders when the actuating projection actuates the one of the sliders to eject the corresponding writing element from the container main body.

7. The pivotal manipulation type writing instrument according to claim 2, wherein the circular track is included in the container main body.

8. The pivotal manipulation type writing instrument according to claim 2, wherein a part of the actuated portion on which the actuating projection is adapted to be abutted extends in a direction perpendicular to a moving direction of the slider.

9. The pivotal manipulation type writing instrument according to claim 8, wherein the actuating projection has a flat surface in a radially outer side of the circular track along which the actuating projection moves.

10. The pivotal manipulation type writing instrument according to claim 1, wherein two sliders mounted to respective writing elements are arranged side by side within the container main body, and a stopper arranged between the two sliders to restrict the sliders from moving backward is integrated with the container main body.

11. The pivotal manipulation type writing instrument according to claim 1, wherein the pivotable body has an internal space capable of housing an arbitrary article.

12. The pivotal manipulation type writing instrument according to claim 11, wherein the arbitrary article that is adapted to be housed in the internal space includes a knife, a ruler, scissors, an earpick, or a storage medium such as a USB memory.

* * * * *